United States Patent [19]

Bassett

[11] Patent Number: 4,679,606

[45] Date of Patent: Jul. 14, 1987

[54] ROUTER TABLE

[76] Inventor: Alvin L. Bassett, 10410 SE. Raymond Ave., Portland, Oreg. 97266

[21] Appl. No.: 882,254

[22] Filed: Jul. 7, 1986

[51] Int. Cl.[4] ..... B27C 9/00; B27C 5/00

[52] U.S. Cl. ..... 144/134 A; 144/253 J; 144/286 R; 409/182

[58] Field of Search ..... 144/134 R, 134 A, 136 R, 144/253 R, 253 J, 286 R, 286 A; 407/54; 409/182

[56] References Cited

U.S. PATENT DOCUMENTS 4,516,612 5/1985 Wiley ..... 144/253 J 4,546,804 10/1985 Haeger ..... 144/286 R

FOREIGN PATENT DOCUMENTS 1921879 11/1969 Fed. Rep. of Germany ... 144/134 A

*Primary Examiner*—W. D. Bray

*Attorney, Agent, or Firm*—John A. Hamilton

[57] ABSTRACT

A router table consisting of a table top formed by two slabs separated by a gap, a raised fence at an end of the table intersected by the gap and bridging the gap, a carriage mounted in the gap for movement toward and from the fence, a router mounted beneath the carriage and including a router bit projecting above the table, the fence being windowed to permit said router bit to pass the plane of the fence if desired in order that the bit may be used to plane the edge of a work piece guided across the table by the fence, the fence being formed of relatively movable sections wich may be offset transversely of the normal fence plane to compensate for any thickness of the work piece edge cut away by the bit, or to close the window when its use is not desired.

8 Claims, 9 Drawing Figures

ROUTER TABLE

This invention relates to new and useful improvements in power driven wookworking tools, and has particular reference to a table having a router mounted therebeneath with its bit projecting above the table surface to shape wood work pieces guided over the table surface.

One object of the present invention is the provision of a device of the general character described which is provided with a raised, spatially fixed fence disposed at one end of the table for guiding work pieces thereover, and the provision of means whereby the routing tool, though spatially fixed relative to the table in actual use, may nevertheless be adjustably moved along the full length of the table, and hence to any desired spacing from the fence, whereby the tool may be set to shape the work piece at any desired distance from the edge thereof guided by the fence. As compared to an arrangement in which the tool is always spatially fixed relative to the table and the fence is adjustably movable over the table to be disposed at a desired distance from the tool, this arrangement permits full utilization of the entire table area at all times, and hence permits the shaping of larger work pieces thereon.

Another object is the provision of a device of the character described having means providing that despite the horizontal adjustability of the routing tool relative to the fence, the table surface remains substantially uninterrupted, especially for a substantial area around the tool bit itself and adjacent the fence. This continuity of the table surface is necessary to the proper support of the work piece to insure efficient operation of the tool.

A further object is the provision of a device of the character described in which the routing bit may be moved adjustably beyond the end of the table at which the fence is mounted, the fence being provided with a window through which the tool may be moved. This permits use of the routing tool bit, or other tools mountable in its place to be used to plane or otherwise shape the edge of the work piece being guided by the fence, as well as for routing operations at substantial distances from the fence.

A still further object is the provision of a special fence to be used when the window described above is desired. The special fence is provided with a movable element capable of covering and closing the window when use of the latter is not desired, and also being movable inwardly over the table at the trailing side of the tool bit, in order that it may still guide the work piece accurately at said trailing side, compensating for the fact that the tool bit may have removed a variable thickness of wood from the work piece.

Other objects are simplicity and economy of construction, and efficiency and dependability of operation.

Figure 1:
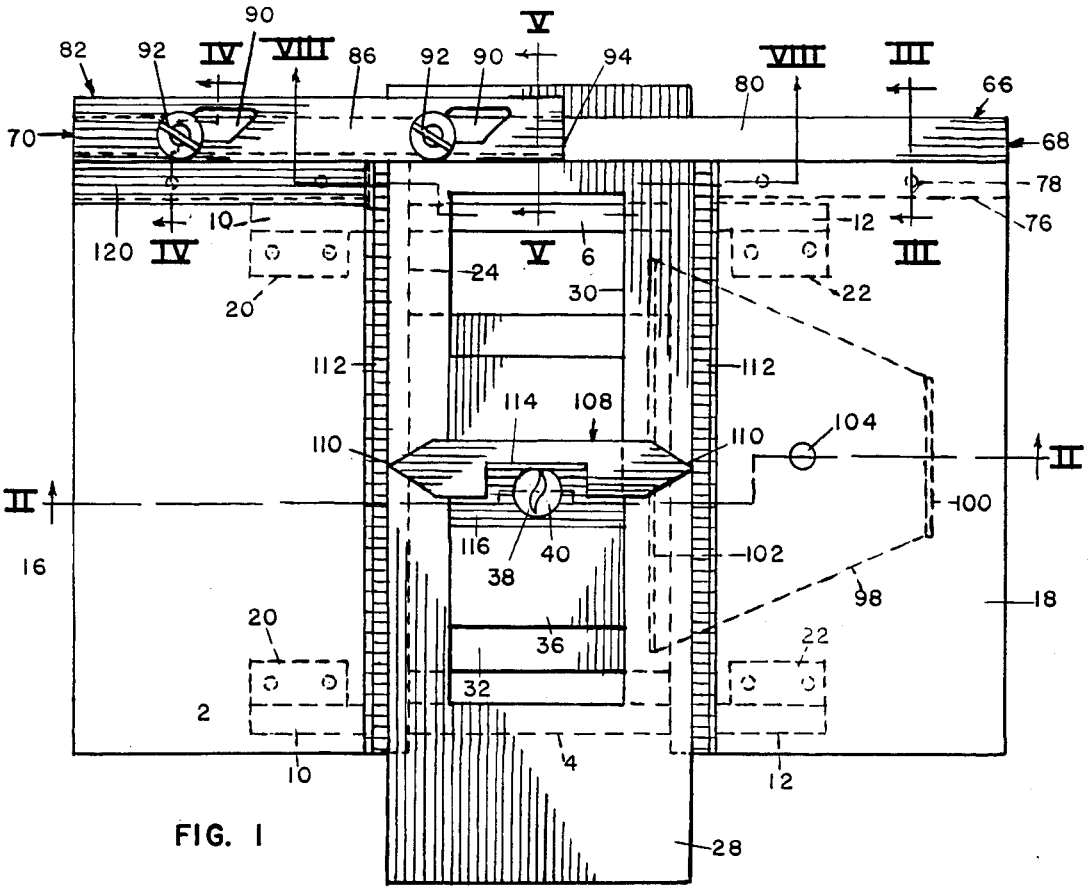
Figure 2:
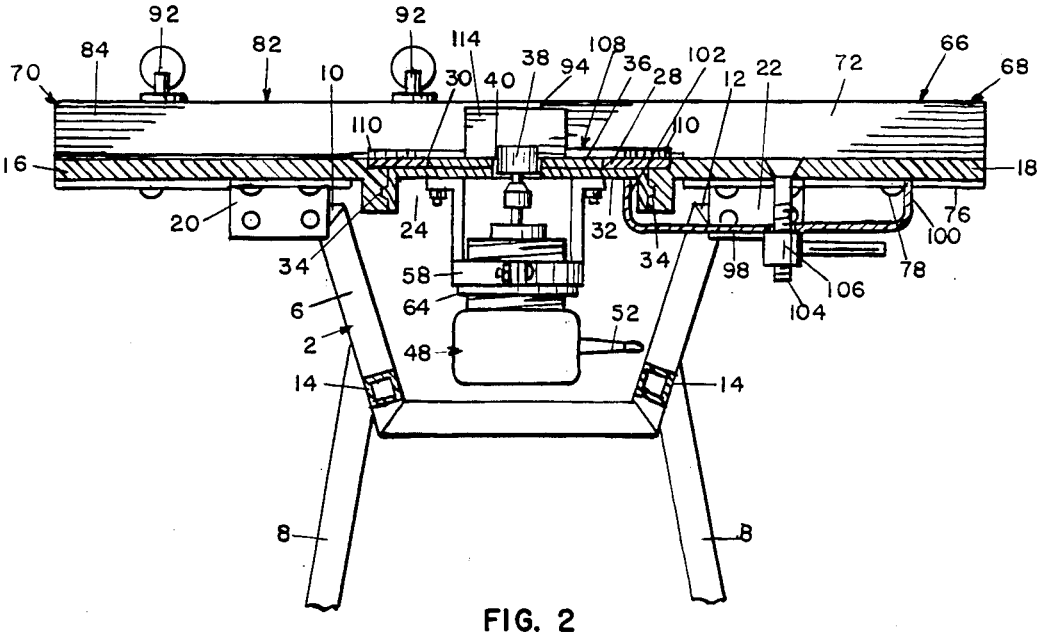
Figure 3:
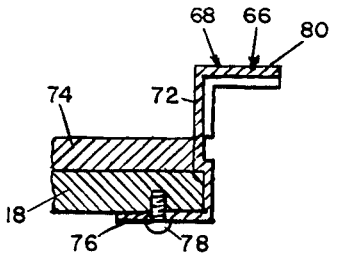
Figure 4:
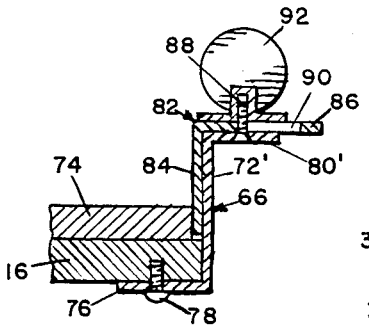
Figure 5:
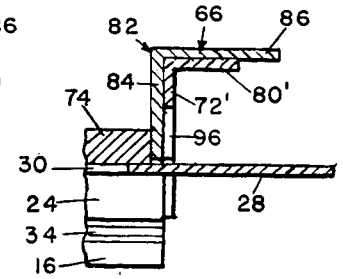
Figure 6:
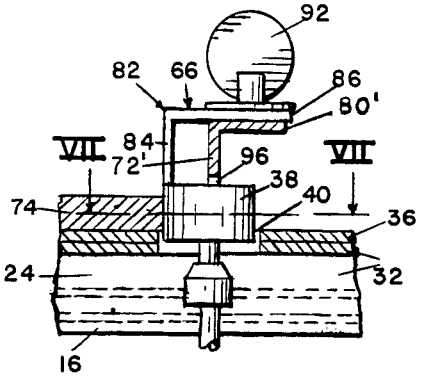
Figure 7:
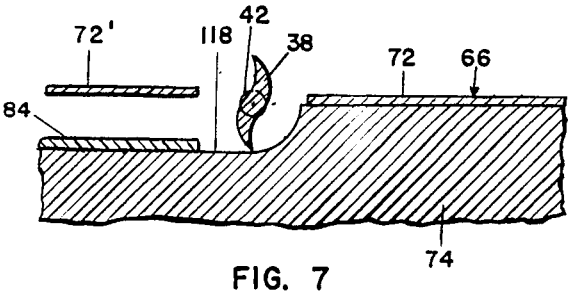
Figure 8:
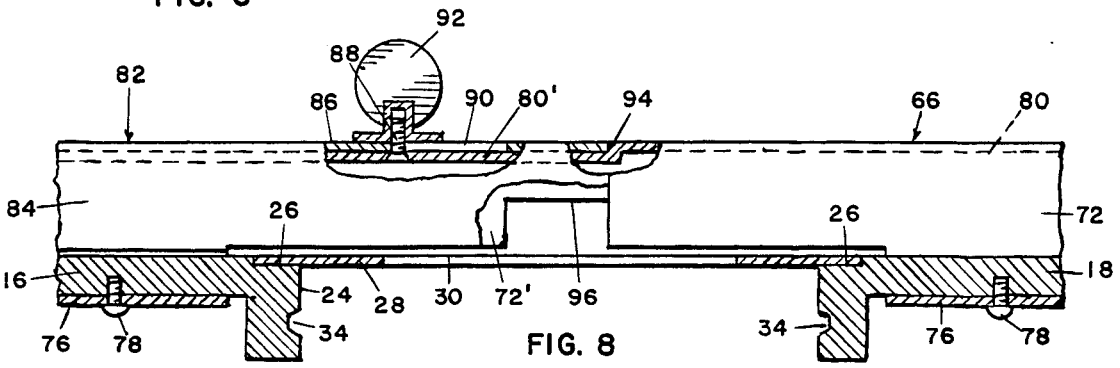
Figure 9:
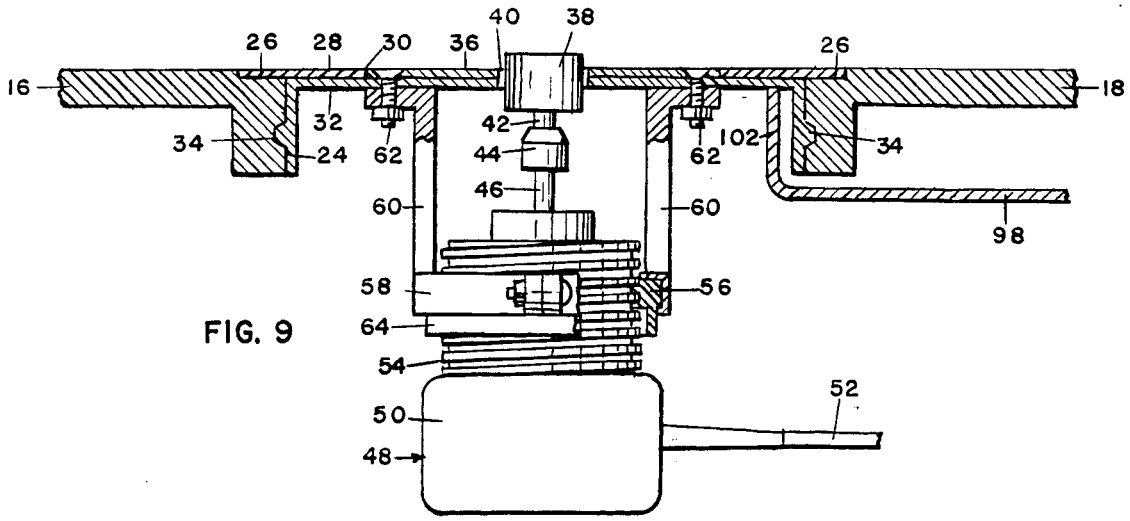

With these objects in view, as well as other objects which will appear in the course of the specification, reference will be had to the accompanying drawing, wherein:

FIG. 1 is a top plan view of a router table embodying the present invention, FIG. 2 is a fragmentary front elevational view of the table as shown in FIG. 1, FIG. 3 is an enlarged, fragmentary sectional view taken on line III—III of FIG. 1, FIG. 4 is an enlarged, fragmentary sectional view taken on line IV—IV of FIG. 1, FIG. 5 is an enlarged, fragmentary sectional view taken on line V—V of FIG. 1, FIG. 6 is a view generally similar to FIG. 5, but showing the router tool bit adjusted to plane the edge of a work piece guided by the fence, FIG. 7 is a fragmentary sectional view taken on line VII—VII of FIG. 6, FIG. 8 is an enlarged, fragmentary sectional view taken on line VIII—VIII of FIG. 1, with parts broken away, and FIG. 9 is an enlarged, fragmentary view similar to the central portion of FIG. 2, but with the gauge member omitted and with additional elements broken away.

Like reference numerals apply to similar parts throughout the several views, and the numeral 2 applies generally to the base structure of the table forming the subject matter of the present invention. Said base structure, as shown, is formed of square tubular stock and is of one-piece integral structure, including a vertical front frame 4 disposed in a plane transverse to the table adjacent its forward edge, and a similar rear frame 6 disposed in forwardly spaced relation from the rearward edge of the table. Each of frames 4 and 6 comprises an upwardly opening U-formation supported by a pair of legs 8 which may be of any desired length, and a pair of horizontal arms 10 and 12 extending respectively to the left and to the right of the upper ends of the U-formation. Frames 4 and 6 are connected rigidly by a pair of forwardly and rearwardly extending horizontal bars 14, as indicated in FIG. 2.

The table top is formed partially by a pair of planar horizontal slabs 16 and 18, the major dimensions of which extend forwardly and rearwardly of the table. Left slab 16 is permanently and rigidly affixed by brackets 20 to the horizontal arms 10 of base frames 4 and 6, and right slab 18 is permanently and rigidly affixed by brackets 22 to the right arms 12 of base frames 4 and 6. The slabs 16 and 18 are spaced apart transversely of the table to define a parallel-sided gap 24 therebetween, said gap extending the full length of the table, and being centered over the U-formations of the base frames 4 and 6. Said gap is bridged at all times by a filler plate 28 of rectangular form, being somewhat longer than table top slabs 16 and 18, and having its side edge portions resting slidably in depressed ledges 26 cut into the upper surfaces of the slabs at their confronting edges, so that the upper surfaces of the slabs and filler plate are coplanar. The filler plate may thus be moved slidably forwardly or rearwardly relative to the table, and may project from either the forward or rearward edge of the table, or both, as shown in FIGS. 1 and 5. Formed in the filler plate is a rectangular opening 30 of substantial length and width.

Also disposed slidably in and spanning the parallel-sided gap 24 of the table top is a router carriage 32, of shorter length than the filler plate, and constituting a horizontal plate, having its longitudinal edge portions turned down and fitted with longitudinally extending ribs engaged slidably in matching grooves formed in the confronting edges of table slabs 16 and 18, whereby to form tongue-and-groove connections 34. Said carriage may at certain positions in its longitudinal sliding movement, project outwardly from either the forward or rearward edge of the table. The upper surface of the carriage plate is disposed flush against the lower surface of filler plate 28, and a plate 36 affixed to the upper surface of the carriage plate projects upwardly through opening 30 of the filler plate to lie flush with the upper surface of said filler plate. The filler plate may be moved longitudinally with respect to the carriage and its plate 36, with the side walls of filler plate opening 30 moving in sliding engagement with the side edges of plate 36.

A rotatable router tool bit 38 is disposed within a circular aperture 40 formed centrally through the top of carriage 32 and its plate 36. The bit is rotatable on a vertical axis, its depending stem 42, (see FIG. 9) being gripped releasably in a chuck 44 fixed on the vertical output shaft 46 of a power drive unit 48 including an electric motor 50 to which electric power is furnished by a flexible cable 52, and a housing 54 which is threaded coaxially with output shaft 46. Said housing is threaded in a horizontally disposed ring nut 56 which is in turn rotatably retained in a heavy ring 58 disposed in spaced relation beneath carriage 32 but rigidly connected thereto by a plurality (two shown) of legs 60 rising therefrom and secured at their upper ends to said carriage by bolts 62. A portion 64 of nut 56 projects from ring 58 to serve as a handle by means of which the nut may be turned manually to raise or lower tool bit 38 adjustably as desired.

Arranged along the rearward edge of the table is a special guide fence 66 for guiding work pieces in a straight line movement over the table surface. Since the work pieces normally are moved from right to left over the table, as viewed in FIGS. 1 and 2, the right portion 68 of the fence will be denoted its leading portion, and the left portion 70 thereof will be denoted its trailing portion. The leading portion 68 constitutes an elongated form presenting, in cross-section, a vertical leg 72 rising from the surface of the table to provide a guide surface for a work piece 74 here illustrated as a flat wooden board, a bottom horizontal flange 76 projecting beneath table slab 18 and secured thereto by screws 78, and a top horizontal flange 80 extending rearwardly from the upper edge of vertical flange 72. This formation extends across the entire rear edge of the table, including a portion thereof bridging the gap 24 between slabs 16 and 18, but in the left portion thereof, its vertical leg 72 and top horizontal leg 80 are offset respectively rearwardly and downwardly, as indicated at 72' and 80', to serve as a support for an angle iron 82 which serves as the actual trailing guide fence, said angle iron including a vertical leg 84 depending closely adjacent the surface of table slab 16, and a horizontal leg 86 overlying leg 80' and secured adjustably thereto by a pair of spaced apart bolts 88 fixed in leg 80', projecting upwardly through enlarged holes 90 in leg 80, and having enlarged clamping wing nuts 92 threaded thereon.

In the portion of right fence member 68 bridging the table gap 24 between slabs 16 and 18, both the lower horizontal flange 76 thereof and the vertical leg 72 thereof are notched away to a sufficiently high elevation that both carriage 32 and filler plate 28 may be projected rearwardly through the fence line, as shown in FIGS. 6 and 7. In addition, the lower edge of vertical leg 72' is notched upwardly from its lower edge to form a window 96 aligned with router bit 38 at the midline of the table, and of sufficient width to pass the largest router bit likely to be used therethrough. The juncture of the legs 72 and 80 of right fence member 68 with legs 72' and 80' thereof is marked by a shoulder 94 facing to the left, and this shoulder is disposed at the right edge of window 96, as best shown in FIG. 8. When the right end of angle iron 82 is lodged firmly against shoulder 94, as in FIG. 8, the vertical leg 84 thereof covers window 96 to avoid any interruption in the guide surface provided by the fence, and legs 84 and 86 of the angle iron form coplanar extensions of legs 72 and 80 of the right fence member 68. The fence in this configuration provides a straight, uninterrupted guide for the full width of the table, and is used when the routing bit 38 is used to shape the work piece at a spaced apart distance from the fence, for example to cut a slot in the work piece, or a groove in its lower surface, in a direction parallel to the fence, as the work piece is guided across the table by sliding it against the fence.

The spacing of the router cut from the fence is determined by the position to which carriage 32 is moved along the length of table slot 24. The carriage is fixed at the desired position by a heavy clamp plate 98 disposed principally beneath right table slab 18, and being substantially horizontal except that one edge thereof is turned upwardly to form a flange 100 engaging the bottom of slab 18, and the opposite edge is turned upwardly to form a flange 102 engaging the bottom side of carriage 32. Said plate is supported by a screw 104 fixed at its upper end in slab 18, depending through a hole provided therefor centrally in the plate, and having a nut 106 threaded thereon beneath the plate, as shown in FIG. 2. When said nut is tightened, the carriage is held firmly against sliding movement along gap 24. The carriage may thus be held firmly with router bit 38 at any point in the full length of the table, or even moved outwardly from either end of the table to some degree.

To assist in positioning the router bit accurately relative to the fence, there is provided a gauge member 108 as shown in FIGS. 1 and 2. Said gauge member comprises an elongated sheet metal member adapted to be laid transversely across the top surfaces of carriage 32 and filler plate 28, and having each end thereof pointed as shown at 110 to indicate a reading on a scale 112 imprinted on the top surface of the adjacent table slab 16 or 18, said scales indicating distance from fence 66. A portion of the gauge member is bent upwardly to form a vertical tab 114, the forward surface of which lies in the same vertical plane as the points 110. To use the gauge, bit 38 is first turned so that a point thereof faces the fence, as shown, and the gauge is laid across the carriage and filler plate, as shown, with tab 114 against the bit and points 110 indicating readings on scales 112. Then, with nut 106 loosened to free the carriage, the carriage is moved lengthwise of the table until gauge points 110 indicate the correct reading on scales 112. To insure that the gauge is held accurately in a line transverse to the table, a series of closely spaced parallel lines 116 may be imprinted on the top surface of carriage plate 36, as shown in FIG. 1. These lines serve as visual reference marks facilitating the holding of the gauge accurately parallel thereto. The router cut formed in the work piece as the latter is moved across the table of course has one edge proximate the fence and one edge distal from the fence. If the spacing of the proximate edge from the fence is the critical dimension, gauge 108 is placed as illustrated, with tab 114 engaging a point of the bit closest to the fence. If the spacing of the distal cut edge from the fence is the critical dimension, on the other hand, gauge 108 is simply reversed end for end, and tab 114 engaged with a point of the bit spaced farthest from the fence. Once the carriage has been properly set, and clamped in position by tightening nut 106, gauge 108 is of course removed.

If it is desired to use routing bit 38, or any other tool mountable in chuck 44, for planing or otherwise shaping the edge of work piece 74 being guided along fence 66, clamp nuts 92 of the left or trailing fence portion are first loosened, and left fence angle iron 82 moved to the left. This uncovers window 96 in fence leg 72', and carriage 32 may then be adjusted rearwardly as already described, to the extent that router bit 38 moves through, or partially through, window 96 of fence leg 72', as shown in FIGS. 6 and 7. That is, the bit is disposed within the window, but its orbit still projects forwardly of right fence 68 to remove a cut of wood from a work piece 74 as said work piece is moved along fence 68, as best shown in FIG. 7 at 118. If the shaping operation being performed on the board edge is of a type which removes a positive material thickness from the board edge, as shown, the vertical leg 84 of trailing fence angle iron 82 is also adjusted forwardly by the same amount, as shown in FIG. 7 and as permitted by the enlarged form of the bolt holes 90 in the top leg 86 of angle iron 82. This provides for accurate guidance and straight line travel of the work piece across the table despite the thickness thereof removed by the bit. A series of closely spaced parallel lines 120 imprinted transversely on the top of table slab 16 adjacent angle iron 82 facilitate the setting of said angle iron accurately parallel to the right or leading fence 68.

Thus it will be apparent that a router table having several advantages has been produced. The routing bit may be spaced at any desired distance from the fence, in an amount limited only by the length of the table. The work piece is always adequately supported, particularly in the area of the bit, by the fact that the bit, while adjustable the full length of the table, requires a hole of only very limited size in the carriage to accomodate it, and that the carriage top plate provides support for the work piece in a wide area around the bit. Good support of the work piece along the fence is also required for accurate and efficient operation, and this support is provided by filler plate 28. Said filler plate may be reversed end-for-end, if necessary, to provide an uninterrupted portion thereof beneath and forwardly of the fence for good work support. The scope and flexibility of the tool is considerably increased by the fact that the tool bit may be moved effectively behind the fence, in order that it may be used to plane or otherwise shape the work edge guided by the fence. Also the fence is specially constructed to provide a window through which the tool bit may move, but only when said edge planing or shaping is desired, and also to compensate for any work thickness removed in the edge shaping operation, so that the guiding function of the fence is not destroyed at the trailing side of the tool bit.

While I have shown and described a specific embodiment of my invention, it will be readily apparent that many minor changes of structure and operation could be made without departing from the spirit of the invention.

What I claim as new and desire to protect by Letters Patent is:

1. A router table comprising:

a. a table having a planar top surface and comprising a pair of coplanar slabs spaced apart to present a parallel-sided gap therebetween, b. a fence disposed along one edge of said table and rising above the top surface thereof whereby a work piece may be guided thereby in a straight line across said table top, the gap between said slabs being disposed at right angles to said fence, c. a carriage having its upper surface coplanar with said slabs mounted slidably between said slabs for movement in said gap at right angles to said fence, and d. a router including a drive unit and a router bit rotatable on a vertical axis, said router drive unit being mounted beneath said carriage and said router bit projecting upwardly through an aperture of said carriage not larger than required to permit free rotation of the bit, the top surface of said carriage extending substantial distances in all directions from said bit aperture to provide solid support for the work piece in the area surrounding said bit.

2. A router table as recited in claim 2 with the addition of a filler plate carried slidably by said table slabs, said filler plate bridging the gap between said slabs and being slidable in a direction at right angles to said fence, said filler plate having an aperture formed therein elongated in a direction at right angles to the fence, and also having transversely uninterrupted portions at the ends of said aperture, said carriage extending upwardly through said aperture to be flush with the filler plate and table slabs, said filler plate and carriage being relatively movable at right angles to the fence, whereby a transversely uninterrupted portion of the filler plate may be disposed directly adjacent said fence, to provide solid support for the work piece, at any position of said carriage relative to said fence.

3. A router table as recited in claim 2 wherein said fence is notched upwardly from its lower edge to permit both said carriage and said filler plate to be extended therethrough, whereby said router bit may be disposed closely adjacent said fence.

4. A router table as recited in claim 2 wherein the horizontal extent to which said router may be moved at right angles to said fence is sufficiently great that said router bit may be moved through the plane of said fence, said fence having a window formed therethrough to permit said bit to do so, whereby said router bit may be utilized to plane or shape the edge of the work piece being guided against said fence.

5. A router table as recited in claim 4 with the addition of means operable to selectively cover or uncover said fence window, depending on whether its use is or is not desired in any given operation.

6. A router table as recited in claim 4 wherein the portion of said fence at the trailing side of said bit is adjustably movable outwardly over the table surface, whereby to compensate for any thickness of the work piece edge removed by said bit and provide for accurate guidance of the work piece at both sides of the router bit.

7. A router table as recited in claim 6 wherein said fence comprises a section at the leading side of the router bit and a section at the trailing side of the bit, the leading and trailing sections being relatively movable transversely to the vertical plane of the fence from a position in which they are coplanar to a position in which the trailing fence section is spaced inwardly over the table relative to the leading section, whereby to compensate for any thickness of the work piece edge removed by said bit.

8. A router table as recited in claim 7 wherein said window is formed in one of said fence members adjacent its juncture with the other of said members, and wherein said fence members are also relatively movable in a direction parallel to said fence, whereby one of said fence members selectively covers or uncovers the window opening of the other.

* * * * *